US008750457B2

(12) United States Patent
Ogura et al.

(10) Patent No.: US 8,750,457 B2
(45) **Date of Patent: *Jun. 10, 2014**

(54) X-RAY GENERATING APPARATUS AND CONTROL METHOD THEREOF

(71) Applicant: Canon Kabushiki Kaisha, Tokyo (JP)

(72) Inventors: Takao Ogura, Sagamihara (JP); Ichiro Nomura, Atsugi (JP); Kazuyuki Ueda, Tokyo (JP); Osamu Tsujii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/897,707

(22) Filed: May 20, 2013

(65) Prior Publication Data

US 2013/0251107 A1 Sep. 26, 2013

Related U.S. Application Data

(63) Continuation of application No. 13/043,982, filed on Mar. 9, 2011, now Pat. No. 8,472,585.

(30) Foreign Application Priority Data

Mar. 23, 2010 (JP) ..... 2010-067031

(51) Int. Cl.
*H05G 1/32* (2006.01)

(52) U.S. Cl.
USPC ..... 378/111; 378/112

(58) Field of Classification Search
USPC ..... 378/101–113, 143, 144
See application file for complete search history.

(56) References Cited

U.S. PATENT DOCUMENTS

| | | | | |
|---|---|---|---|---|
| 7,050,537 | B2 | 5/2006 | Tsujii | 378/95 |
| 7,873,146 | B2 | 1/2011 | Okunuki et al. | 378/122 |
| 7,889,844 | B2 | 2/2011 | Okunuki et al. | 378/122 |
| 8,472,585 | B2 * | 6/2013 | Ogura et al. | 378/111 |
| 2009/0232270 | A1 | 9/2009 | Okunuki et al. | 378/5 |
| 2009/0316860 | A1 | 12/2009 | Okunuki et al. | 378/122 |

FOREIGN PATENT DOCUMENTS

| | | |
|---|---|---|
| JP | A 2007-265981 | 10/2007 |

* cited by examiner

*Primary Examiner* — Courtney Thomas
(74) *Attorney, Agent, or Firm* — Fitzpatrick, Cella, Harper & Scinto

(57) ABSTRACT

An X-ray generating apparatus controls driving of an X-ray tube. The X-ray tube includes an electron source emitting electrons due to application of a voltage, a transmission-type target generating an X-ray due to collision of electrons emitted from the electron source, and a shield member disposed between the electron source and the transmission-type target, the shield member having an opening that electrons emitted from the electron source pass through, and blocking an X-ray that scatters toward the electron source. When generating the X-ray, application of a voltage to the transmission-type target is started, and emission of electrons from the electron source is caused after passage of a predetermined period indicating a time period from starting voltage application until the transmission-type target reaches a predetermined voltage. When stopping X-ray generation, application of the voltage to the transmission-type target is stopped after stopping the emission of electrons from the electron source.

7 Claims, 8 Drawing Sheets

X-RAY GENERATING APPARATUS AND CONTROL METHOD THEREOF

RELATED APPLICATIONS

The present application is a continuation of application Ser. No. 13/043,982, filed Mar. 9, 2011. The present application claims benefit of that application under 35 U.S.C. §120, and claims priority benefit under 35 U.S.C. §119 of Japanese Patent Application 2010-067031, filed Mar. 23, 2010. The entire contents of each of the mentioned prior applications are incorporated herein by reference.

BACKGROUND OF THE INVENTION

1. Field of the Invention

The present invention relates to an X-ray generating apparatus and a control method thereof.

2. Description of the Related Art

Among X-ray tubes, there are X-ray tubes that employ a reflecting-type target and those that employ a transmission-type target. In either type of X-ray tube, a target is irradiated with an electron beam that has been accelerated to high speed, and thus an X-ray is generated from the irradiated area. At this time, X-rays are emitted in all directions. Therefore, in many X-ray tubes, in order to block an X-ray travelling in a direction other than that which is necessary, an X-ray shield member of lead or the like is used to cover a chamber into which the X-ray tube has been inserted or an area surrounding the X-ray tube. In Japanese Patent Laid-Open No. 2007-265981, technology is disclosed in which emission of an X-ray in a direction other than that which is necessary, is suppressed by providing a front shield member and a rear shield member.

Here, FIG. 8A shows an example configuration of a conventional X-ray tube 120. An electron beam 201 that has been radiated from an electron source 121 irradiates a transmission-type target 124 via an opening provided in a rear shield member 122. Thus, an X-ray is generated in all directions from the irradiated area.

The transmission-type target 124 is provided with a front shield member 123 on the opposite side as the electron source 121. An X-ray (203) generated from the irradiated area of the transmission-type target 124 is irradiated toward a subject via an opening provided in the front shield member 123. The rear shield member 122 and the front shield member 123 are provided in order to suppress emission of an X-ray in a direction other than that which is necessary.

Here, when radiating the electron beam 201, a voltage is applied to the transmission-type target 124, and a high voltage is applied between the electron source 121 and the transmission-type target 124. Depending on the timing of application of the voltage to the transmission-type target 124 and the timing of radiation of the electron beam 201 from the electron source 121, there may be instances when the rear shield member 122 does not operate effectively, and thus an X-ray is emitted in an unnecessary direction.

The reason for this is that the voltage applied between the electron source 121 and the transmission-type target 124 increases as a slope relative to the application time. That is, even if voltage is already being applied to the transmission-type target 124, the transmission-type target 124 does not instantly reach a predetermined voltage. Therefore, immediately after starting voltage application, the voltage is low, so the electron beam is also radiated to an unnecessary area. For example, as shown in FIG. 8B, an electron beam is radiated also to the rear shield member 122, and thus an X-ray 205 is generated from the rear shield member 122. The X-ray 205 generated from the rear shield member 122 is unnecessary, and needs to be eliminated.

Even if the rear shield member 122 is provided as described above, depending on when the voltage is applied to the transmission-type target 124 and when an electron beam is radiated from the electron source 121, there is a possibility that an unnecessary X-ray will be generated.

SUMMARY OF THE INVENTION

The present invention provides technology that enables suppression of the generation of an unnecessary X-ray without changing the size or weight of an X-ray tube.

According to a first aspect of the present invention there is provided an X-ray generating apparatus, comprising: an X-ray tube configured to generate an X-ray; and a controller configured to control driving of the X-ray tube; the X-ray tube comprising: an electron source configured to emit electrons due to application of a voltage; a transmission-type target configured to generate an X-ray due to collision of electrons emitted from the electron source; and a shield member disposed between the electron source and the transmission-type target, the shield member having an opening that electrons emitted from the electron source pass through, and the shield member being configured to block an X-ray that scatters toward the electron source; the controller being configured to, when generating the X-ray, start application of a voltage to the transmission-type target, and cause emission of electrons from the electron source after passage of a predetermined period indicating a time period from the start of voltage application until the transmission-type target reaches a predetermined voltage, and when stopping generation of the X-ray, stop application of the voltage to the transmission-type target after stopping the emission of electrons from the electron source.

According to a second aspect of the present invention there is provided an X-ray generating apparatus, comprising: an X-ray tube configured to generate an X-ray; and a controller configured to control driving of the X-ray tube; the X-ray tube comprising: an electron source configured to emit electrons due to application of a voltage; a transmission-type target configured to generate an X-ray due to collision of electrons emitted from the electron source; a shield member disposed between the electron source and the transmission-type target, the shield member having an opening that electrons emitted from the electron source pass through, and the shield member being configured to block an X-ray that scatters toward the electron source; and a lens electrode disposed between the electron source and the shield member, and being applied by a first voltage that is less than the voltage applied to the electron source; the controller being configured to, when generating the X-ray, start application of a voltage to the transmission-type target after switching the voltage applied to the lens electrode from the first voltage to a second voltage that is a higher voltage than the voltage applied to the electron source, and when stopping generation of the X-ray, switch the voltage applied to the lens electrode from the second voltage to the first voltage after stopping application of the voltage to the transmission-type target.

According to a third aspect of the present invention there is provided a control method of an X-ray generating apparatus configured to control driving of an X-ray tube, the X-ray tube comprising: an electron source configured to emit electrons due to application of a voltage; a transmission-type target configured to generate an X-ray due to collision of electrons emitted from the electron source; and a shield member disposed between the electron source and the transmission-type target, the shield member having an opening that electrons emitted from the electron source pass through, and the shield member being configured to block an X-ray that scatters towards the electron source; the control method comprising: when generating the X-ray, starting application of a voltage to the transmission-type target, and causing emission of electrons from the electron source after passage of a predetermined period indicating a time period from the start of voltage application until the transmission-type target reaches a predetermined voltage; and when stopping generation of the X-ray, stopping application of the voltage to the transmission-type target after stopping the emission of electrons from the electron source.

According to a fourth aspect of the present invention there is provided a control method of an X-ray generating apparatus configured to control driving of an X-ray tube, the X-ray tube comprising: an electron source configured to emit electrons due to application of a voltage; a transmission-type target configured to generate an X-ray due to collision of electrons emitted from the electron source; a shield member disposed between the electron source and the transmission-type target, the shield member having an opening that electrons emitted from the electron source pass through, and the shield member being configured to block an X-ray that scatters toward the electron source; and a lens electrode disposed between the electron source and the shield member, and being applied by a first voltage that is less than the voltage applied to the electron source; the control method comprising: when generating the X-ray, starting application of a voltage to the transmission-type target after switching the voltage applied to the lens electrode from the first voltage to a second voltage that is a higher voltage than the voltage applied to the electron source; and when stopping generation of the X-ray, switching the voltage applied to the lens electrode from the second voltage to the first voltage after stopping application of the voltage to the transmission-type target.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Embodiment 1

Figure 1:
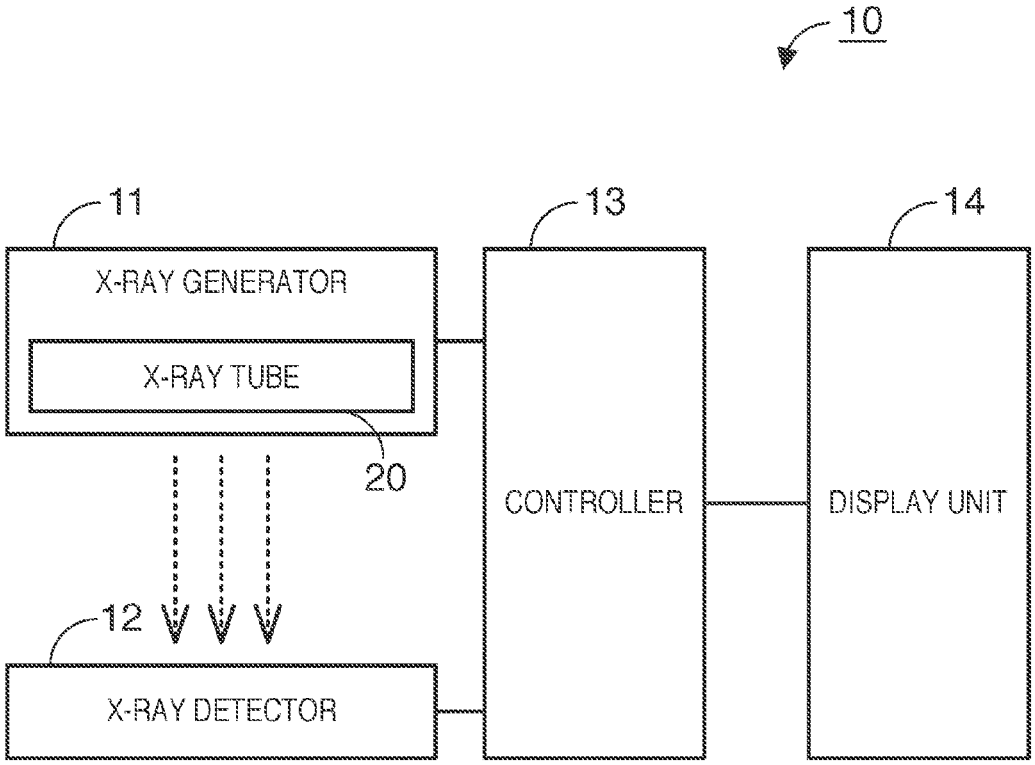
FIG. 1 shows an example of the functional configuration of a radiography apparatus 10 according to one embodiment of the present invention.

FIG. 1 shows an example of the functional configuration of a radiography apparatus 10 according to one embodiment of the present invention.

The radiography apparatus 10 is configured including one or a plurality of computers. Provided in the computer are, for example, a main controller such as a CPU, and storage units such as a ROM (Read Only Memory) and a RAM (Random Access Memory). The computer may also be provided with a communications unit such as a network card, and input/output units such as a keyboard, a display, or a touch panel. Each of these constituent units is connected via a bus or the like, and is controlled by the main controller executing a program stored in a storage unit.

Here, the radiography apparatus 10 is configured including an X-ray generator 11, an X-ray detector 12, a controller 13, and a display unit 14.

The X-ray generator 11 fulfills a role of irradiating an X-ray toward a subject (for example, a person). An X-ray tube 20 that generates an X-ray, described in detail later, is provided in the X-ray generator 11. The X-ray tube 20 emits hot electrons from a filament heated to a high temperature, and accelerates an electron beam to a high energy via an electrode. After an electron beam has been formed in a desired shape, that electron beam is radiated to a transmission-type target to generate an X-ray.

The X-ray detector 12 detects an X-ray from the X-ray generator 11 that has been transmitted through the subject. Thus, an X-ray image based on the subject is captured. The controller 13 performs central control of processing in the radiography apparatus 10. For example, the controller 13 controls radiography by the X-ray generator 11 and the X-ray detector 12. Also, for example, the controller 13 controls driving of the X-ray tube 20. The display unit 14 displays the radiographic image of the subject that was captured by the X-ray detector 12.

Foregoing is the description of an example configuration of the radiography apparatus 10. However, the X-ray detector 12 and the display unit 14 are not essential constituent elements. For example, the invention may also be embodied in an X-ray generating apparatus provided with the X-ray tube 20.

Figure 2:
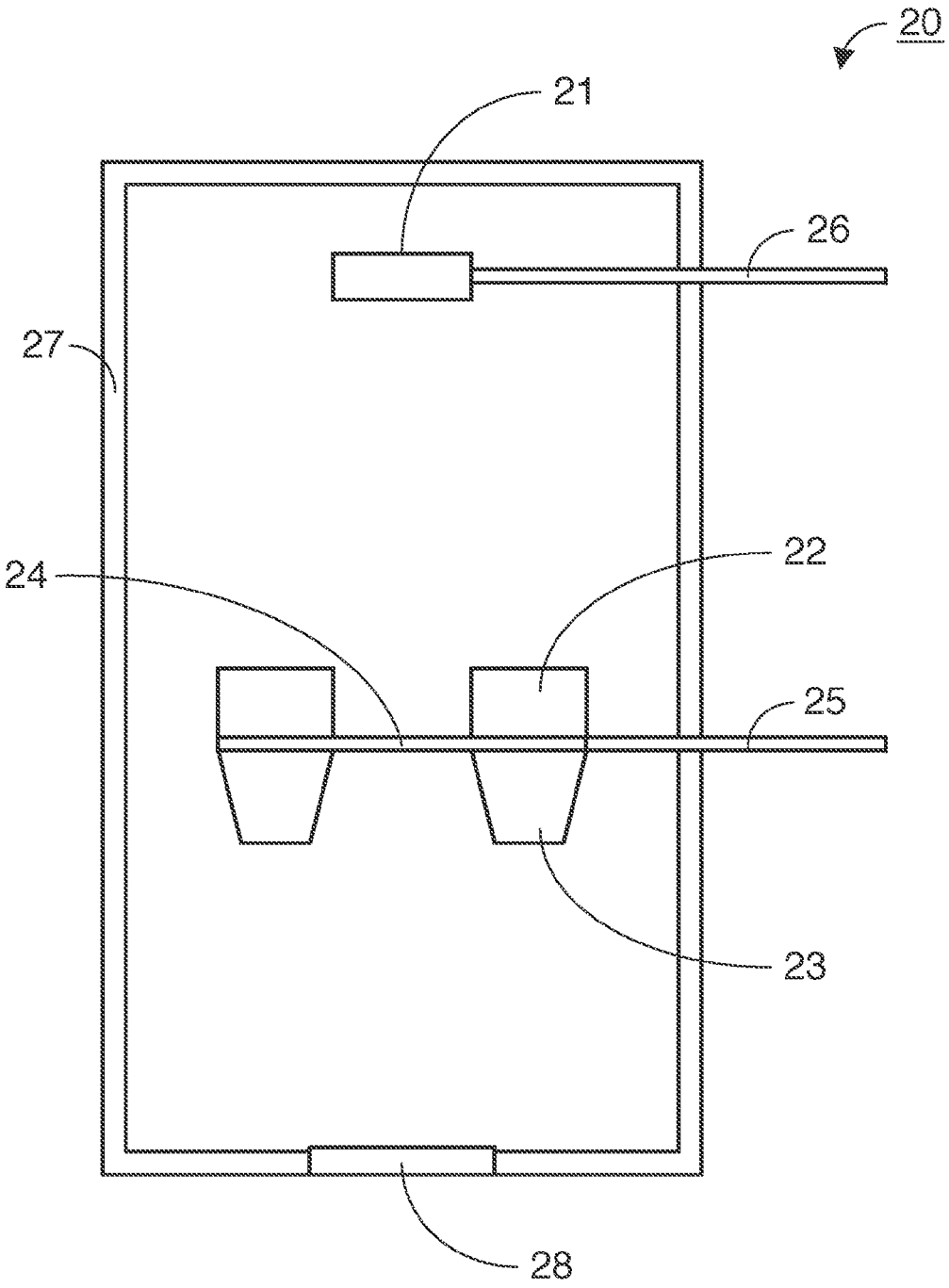
FIG. 2 shows an example configuration of an X-ray tube 20 shown in FIG. 1.

Next is a description of an example configuration of the X-ray tube 20 shown in FIG. 1, with reference to FIG. 2.

The X-ray tube 20 is configured including an electron source 21, a rear shield member 22, a front shield member 23, a transmission-type target 24, wirings 25 and 26, and a vacuum chamber 27.

The electron source 21 radiates an electron beam. More specifically, the electron source 21 emits electrons, and accelerates those electrons to high speed and causes them to collide with the transmission-type target 24. Thus, an X-ray is generated. The wiring 26 applies a voltage to the electron source 21, and is connected to the electron source 21. The electron source 21 may be a cold cathode such as a carbon nanotube, or may be a hot cathode such as a tungsten filament or an impregnated cathode. An extracting electrode for extracting electrons from a heated electron source surface is disposed in the electron source 21. Conditions of electron extraction differ by the type of electron source. Here, the extracting electrode is included in the electron source 21, and is not shown.

Among X-rays generated in all directions due to the collision of electrons with the transmission-type target 24, the rear shield member 22 blocks X-rays generated toward the rear (the electron source side). That is, the rear shield member 22 blocks X-rays that scatter toward the rear (the electron source side). Electrons emitted from the electron source 21 pass through an opening provided in the rear shield member 22. By way of example, a material that includes a heavy metal having a significant shielding effect such as tungsten or tantalum can be used for the rear shield member 22.

Among X-rays generated in all directions due to the collision of electrons with the transmission-type target 24, the front shield member 23 blocks part of X-rays generated toward the front (the opposite side as the electron source 21). More specifically, the front shield member 23 blocks X-rays generated in a direction other than the direction of an X-ray transmission window 28. The generated X-rays pass through an opening provided in the front shield member 23. Like the rear shield member 22, by way of example, a material that includes a heavy metal having a significant shielding effect such as tungsten or tantalum can be used for the front shield member 23.

The transmission-type target 24 generates X-rays corresponding to the electron beam irradiated from the electron source 21. When irradiating the electron beam, it is necessary that a predetermined voltage (a high voltage, for example 100 kV) is applied between the electron source 21 and the transmission-type target 24. Therefore, the wiring 25 that applies a voltage (a high voltage) is connected to the transmission-type target 24.

For the transmission-type target 24, a material that includes a heavy metal having a high melting point and good X-ray generation efficiency, such as tungsten or tantalum, can be used, for example. Also, depending on the application, although not a heavy metal, molybdenum or the like can be used. As for the structure of the transmission-type target 24, a configuration having only a thin metal film of tungsten or the like may be adopted, or for example, a configuration may be adopted that has a layered body including a material that transmits X-rays well, such as carbon. For example, when the transmission-type target 24 has been configured with a thin metal film, the thickness of that film is approximately several μm to several tens of μm, with the thickness differing depending on the type of metal used or the like.

The voltage applied to the transmission-type target 24 differs depending on the usage application, but for example, in the case of a medical X-ray tube in which tungsten is used, the voltage is 80 to 110 kV, for example. When a high voltage has been applied to the transmission-type target 24, approximately the same voltage as the voltage applied to the transmission-type target 24 is also applied to the rear shield member 22 and the front shield member 23.

The vacuum chamber 27 fulfills a role of maintaining a vacuum within the X-ray tube 20. It is sufficient that the vacuum chamber 27 is capable of holding a vacuum degree on the order of 10-5 Pascals, and for the material of the vacuum chamber 27, for example, a glass, a metal, or a ceramic can be used. The X-ray transmission window 28 is provided in the vacuum chamber 27. The X-ray transmission window 28 is an opening formed in order to irradiate an X-ray toward a subject. It is sufficient to use a light metal such as beryllium or a ceramic material such as glass in the X-ray transmission window 28.

Figure 3:
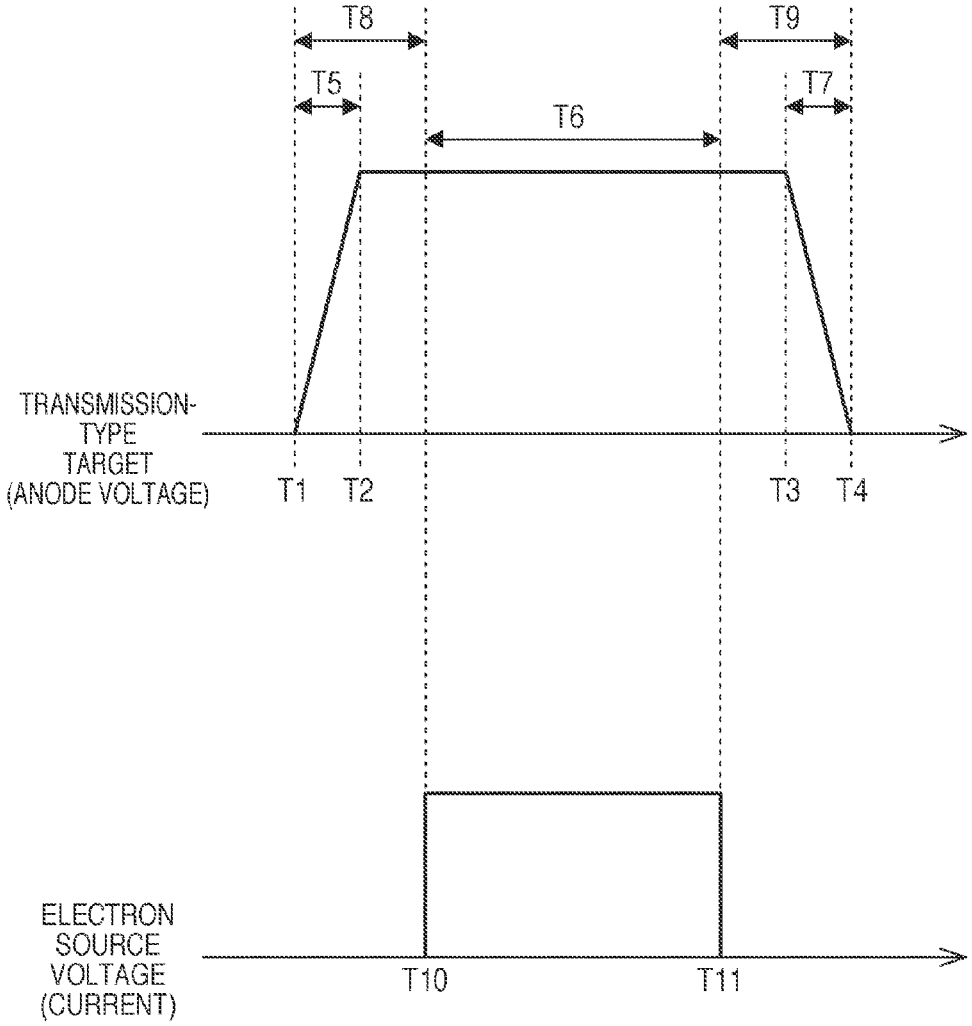
FIG. 3 shows an example of control of operation of the X-ray tube 20 in a controller 13 shown in FIG. 1.

Next is a description of an example of control of operation of the X-ray tube 20 in the controller 13 shown in FIG. 1, with reference to FIG. 3. FIG. 3 shows the time of application of the voltage applied to the transmission-type target 24, and the time of emission of electrons by the electron source 21. The horizontal axis is the time axis.

The controller 13, first, at a time T1, applies a high voltage (a predetermined voltage) to the transmission-type target 24. There is a slight delay (a period T5) until the transmission-type target 24 reaches the predetermined voltage. Information prescribing the time period (predetermined period) until the transmission-type target 24 reaches the predetermined voltage is held in the controller 13.

Here, the transmission-type target 24 reaches the predetermined voltage at a time T2. When the transmission-type target 24 reaches the predetermined voltage, the controller 13, at a time T10, causes generation of electron beams from the electron source 21.

When a predetermined X-ray generation time period (a period T6) has passed, the controller 13, at a time T11, stops the generation of electron beams by the electron source 21. Then, at a time T3, the controller 13 also stops the application of voltage to the transmission-type target 24. The voltage that has been applied to the transmission-type target 24 actually returns approximately completely to its original state at time T4.

Here, during the period T5 (from the time T1 to the time T2), the voltage is being applied to the transmission-type target 24, but because electrons are not being emitted (electron beams are not being radiated) from the electron source 21, an X-ray is not generated. During the period T6 (from the time T10 to the time T11), electrons are emitted from the electron source 21 and also, the predetermined voltage is being applied to the transmission-type target 24, so all of the emitted electrons collide with the transmission-type target. Therefore, only a necessary X-ray is generated from the opening of the front shield member 23, and an unnecessary X-ray is not generated from the rear shield member 22.

At the time T11, emission of electrons by the electron source 21 stops, so X-ray generation also stops. At the time T3, application of voltage to the transmission-type target 24 is stopped, so the voltage of the transmission-type target 24 is less than the predetermined voltage. Therefore, an X-ray is not generated from the time T3 onward.

A period T8 from the time (T1) when application of voltage to the transmission-type target 24 starts to the time (T10) when radiation of an electron beam by the electron source 21 starts corresponds to the time period needed for the transmission-type target 24 to reach an approximately constant voltage (the predetermined voltage). The period T8 is desirably about 0.3 to 2 msec, for example.

The period T6 is a time period during which an X-ray is generated, and is about 10 msec to 1 sec, for example. At the time T11, emission of electrons by the electron source 21 ends, so it is sufficient that the time T3 (the time when application of the voltage to the transmission-type target 24 ends) is after the time T11.

If the time T10 is between the time T1 and the time T2, the transmission-type target 24 will not have reached the predetermined voltage, so electrons emitted from the electron source 21 will collide with an area other than the transmission-type target 24. In this case, an unnecessary X-ray is generated.

As described above, according to the present embodiment, when generating an X-ray, the electron source 21 is caused to emit electrons after the transmission-type target 24 has reached the predetermined voltage. Also, when X-ray generation ends, application of voltage to the transmission-type target 24 is stopped after stopping emission of electrons from the electron source 21. Thus, it is possible to suppress generation of an unnecessary X-ray without changing the size or weight of the X-ray tube.

Embodiment 2

Figure 4:
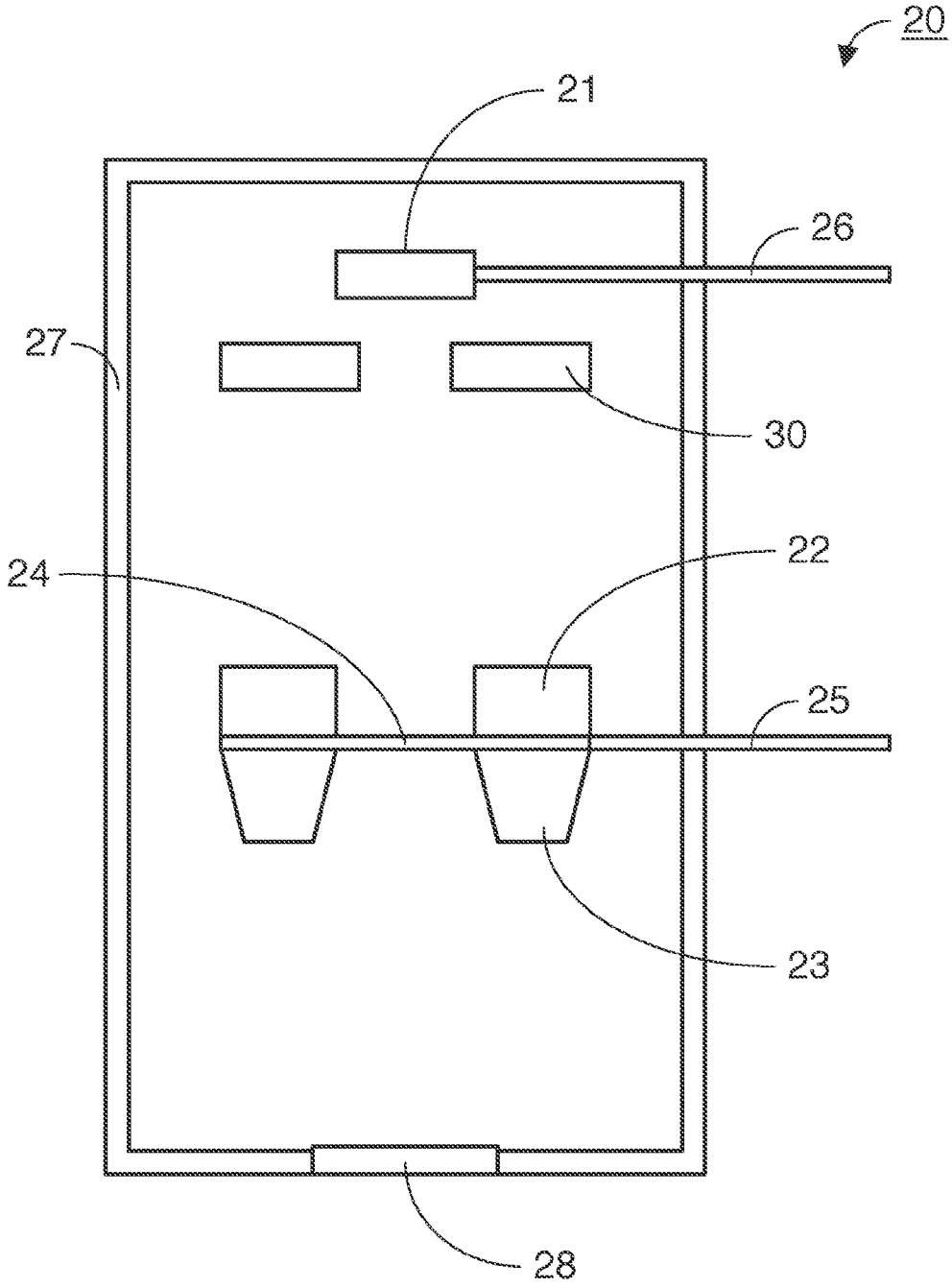
FIG. 4 shows an example configuration of an X-ray tube 20 according to Embodiment 2.

Next is a description of Embodiment 2. FIG. 4 shows an example configuration of an X-ray tube 20 according to Embodiment 2. Aspects of the configuration that are the same as in FIG. 2 illustrating Embodiment 1 are assigned the same reference numbers, and a description thereof may be omitted here.

In the X-ray tube 20 according to Embodiment 2, a lens electrode 30 is provided between an electron source 21 and a rear shield member 22. The lens electrode 30 forms an electron beam irradiated from the electron source 21 by operation of a lens. A first voltage that is a voltage that does not cause lens operation, and a second voltage that is a voltage that causes lens operation, are applied to the lens electrode 30. More specifically, the first voltage is a voltage lower than the voltage applied to the electron source 21, and the second voltage is a voltage higher than the voltage applied to the electron source 21.

Figure 5:
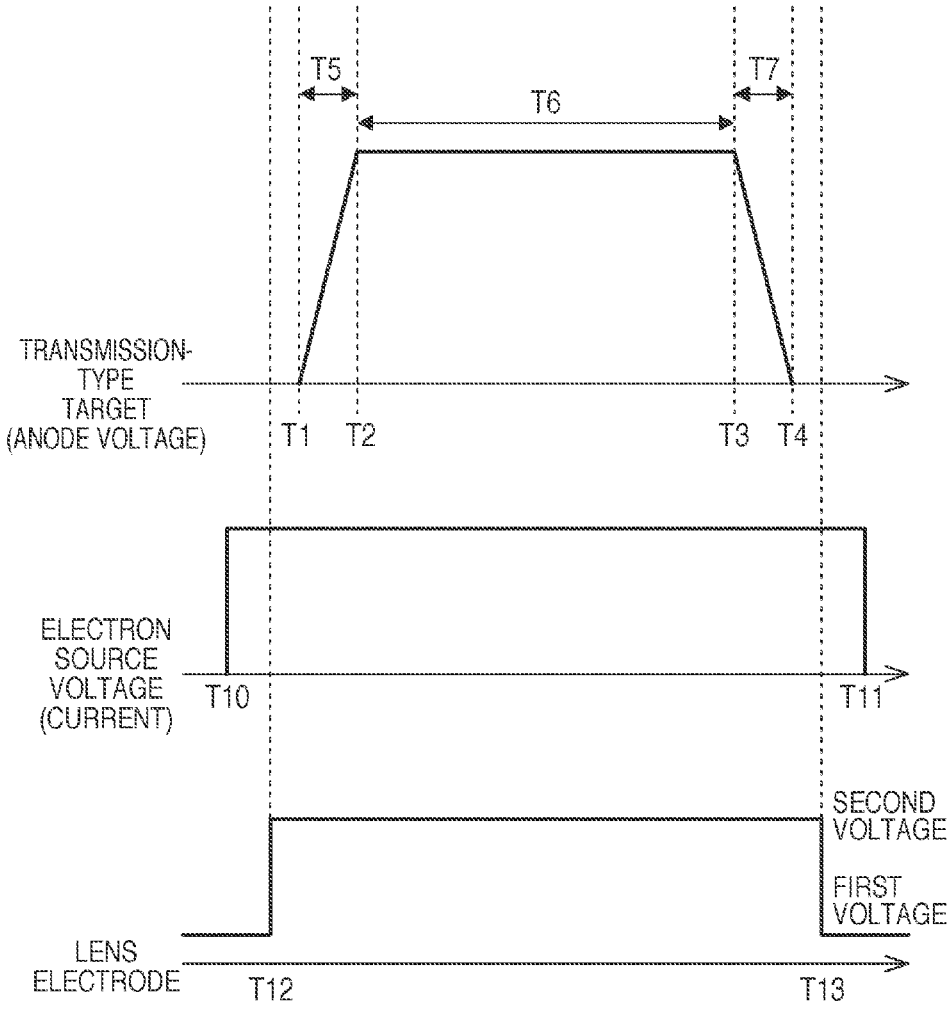
FIG. 5 shows an example of control of operation of the X-ray tube 20 according to Embodiment 2.

Next is a description of an example of control of operation of the X-ray tube 20 according to Embodiment 2, with reference to FIG. 5. FIG. 5 shows times when voltage is applied to the transmission-type target 24, when electrons are emitted by the electron source 21, and when voltage is applied to the lens electrode 30. The horizontal axis is the time axis.

Times T1 to T11 are the same as the times shown in FIG. 3 illustrating Embodiment 1. In FIG. 5, a time T12 when the voltage applied to the lens electrode 30 is switched (from the first voltage to the second voltage), and a time 13 when the voltage applied to the lens electrode 30 is switched (from the second voltage to the first voltage), are added.

When simply applying a voltage to the transmission-type target 24 in a state in which electrons are being emitted by the electron source 21, an X-ray is unintentionally generated toward the rear of the rear shield member 22 (the electron source 21 side). However, here, the second voltage is being applied to the lens electrode 30 before a voltage is applied to the transmission-type target 24, so even if electrons have been emitted from the electron source 21, most electrons flow to the lens electrode 30.

For example, a voltage of about 100 kV is applied to the transmission-type target 24, but such a high voltage is not applied to the lens electrode 30 or the electron source 21. The potential applied to the lens electrode 30 is no more than several kV, and the energy of an X-ray generated at this level is 1 to 2 keV. Therefore, the generated X-ray is substantially absorbed by the chamber of an ordinary X-ray tube. As the voltage applied to the transmission-type target 24 approaches the predetermined voltage, the current that flows to the transmission-type target 24 also increases.

In the case of FIG. 5, when generating an X-ray, at the time T12, a voltage is applied to the lens electrode 30 after switching from the first voltage to the second voltage, prior to the time T1. Also, when stopping X-ray generation, at the time T13, a voltage is applied to the lens electrode 30 after switching from the second voltage to the first voltage, after the time T4.

When, as described above, a configuration is adopted in which the second voltage is applied to the lens electrode 30 throughout all of the periods in which a voltage is applied to the transmission-type target 24, the time when electrons are emitted from the electron source 21 is not limited to the time shown in FIG. 5. For example, the time T10 may be moved to after the time T12, or the time T11 may be moved to prior to the time T13.

As described above, according to Embodiment 2, the second voltage is applied to the lens electrode 30 throughout all of the periods in which a voltage is applied to the transmission-type target 24. Thus, there is greater freedom for setting the time when electrons are emitted by the electron source 21.

Embodiment 3

Next is a description of Embodiment 3. The configuration of an X-ray tube 20 according to Embodiment 3 is the same as in FIG. 4 illustrating Embodiment 2, so a description thereof is omitted here. Below, points that differ from Embodiment 2 will be described. Among differing points are the time when electrons are emitted by the electron source 21, and the time when a voltage is applied to the lens electrode 30.

Figure 6:
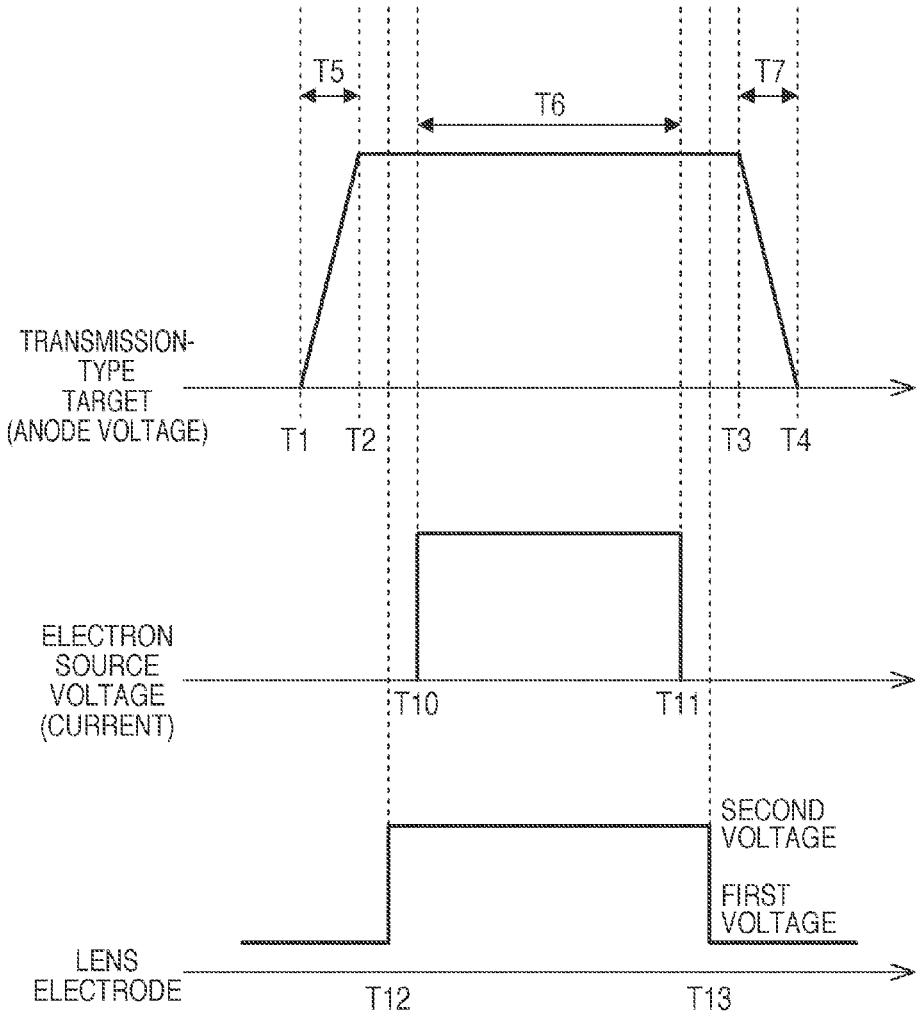
FIG. 6 shows an example of control of operation of an X-ray tube 20 according to Embodiment 3.

An example of control of operation of the X-ray tube 20 according to Embodiment 3 will be described with reference to FIG. 6.

The controller 13 applies the second voltage to the lens electrode 30 at the time T12. That is, application of the second voltage to the lens electrode 30 is performed after the transmission-type target 24 has reached the predetermined voltage at the time T2, and prior to emission of electrons from the electron source 21 at the time T10.

When stopping X-ray generation, the controller 13 stops emission of electrons by the electron source 21 at the time T11, and switches the voltage applied to the lens electrode 30 from the second voltage to the first voltage at the time T13. Afterward, the controller 13 stops application of a voltage to the transmission-type target 24 at the time T3.

In this case, because the second voltage is certainly being applied to the lens electrode 30 when electrons are emitted from the electron source 21, in comparison to Embodiment 1, the electron beam is constricted, so it is possible to further suppress generation of an unnecessary X-ray. Also, even if, due to mistaken operation, electrons have been emitted from the electron source 21 in a state in which the transmission-type target 24 has not reached the predetermined voltage, if the second voltage is being applied to the lens electrode 30, there is substantially no radiation of the electron beam to the transmission-type target 24 or the rear shield member 22. In this case, many electrons flow to the lens electrode 30. Therefore, it is possible to further suppress generation of an unnecessary X-ray.

As described above, according to Embodiment 3, even when the above mistaken operation or the like has occurred, it is possible to suppress generation of an unnecessary X-ray. Therefore, an unnecessary X-ray does not leak outside of the vacuum chamber 27, for example.

The first voltage applied to the lens electrode 30 described in Embodiment 2 and Embodiment 3 may have a negative potential. The negative potential is, for example, at least about −0.1 kV, and about negative several kV is desirable. If the potential of the lens electrode 30 is negative, generated electrons return in the direction of the electron source 21, and flow to a ground. At such a time, even if a high voltage has been applied to the transmission-type target 24, an unnecessary X-ray is not generated.

The foregoing are examples of representative embodiments of the present invention, but the present invention is not limited to the embodiments described above and shown in the drawings, and may be embodied in an appropriately modified form without departing from the gist thereof.

Figure 7:
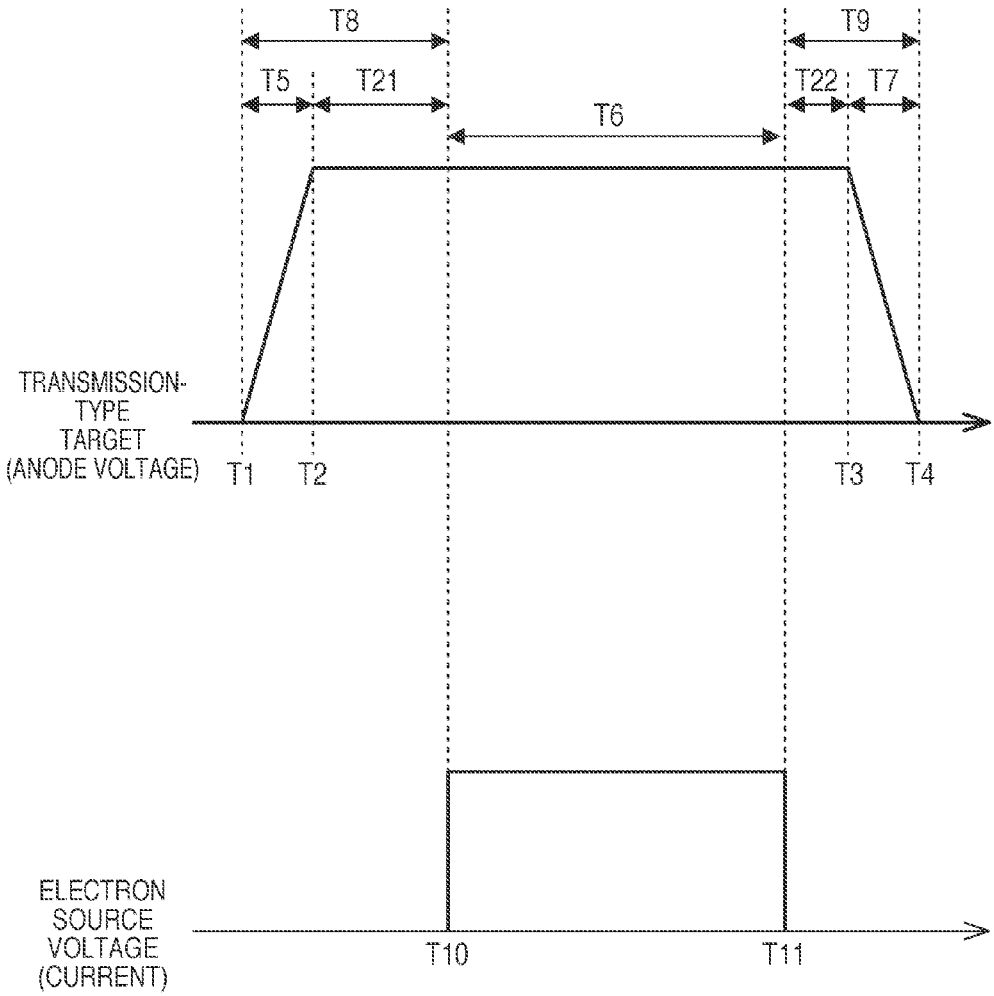
FIG. 7 shows an example of control of operation of an X-ray tube 20 according to a modified example.
Figure 8A:
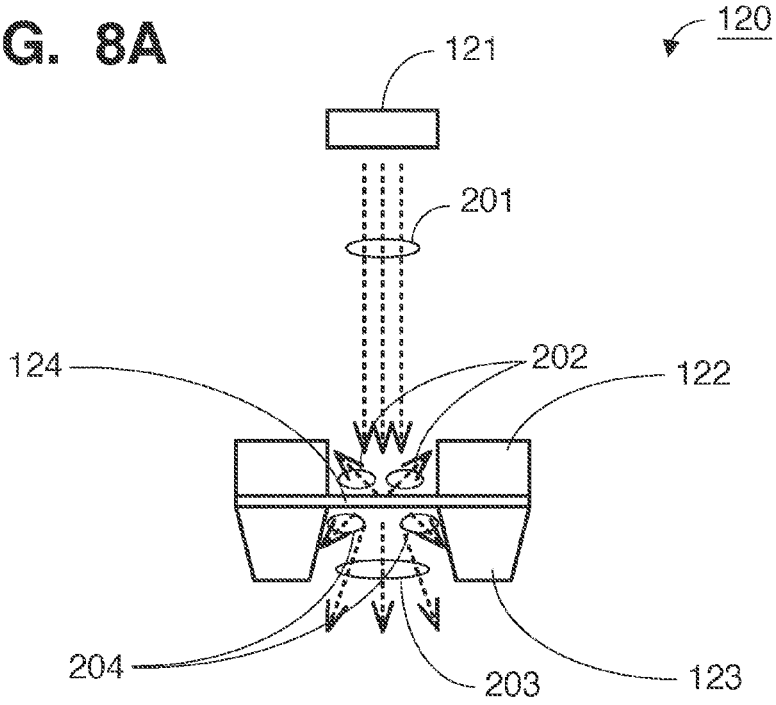
FIGS. 8A and 8B show an example according to the conventional technology.
Figure 8B:
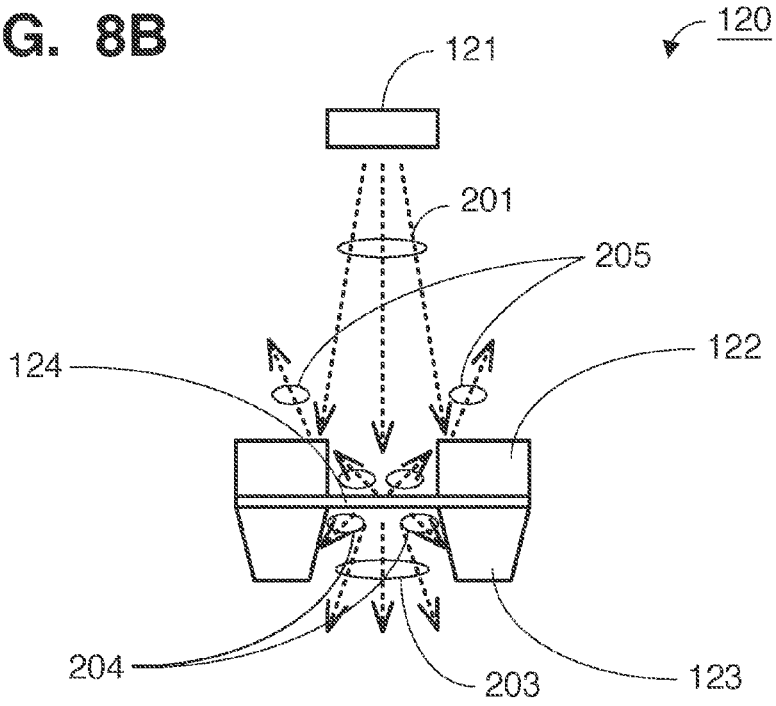

For example, in above Embodiment 1, the time when electrons are emitted from an electron source and the time when a voltage is applied to the transmission-type target 24 were described with reference to FIG. 3, but these operations do not necessary need to be performed at such times. For example, as shown in FIG. 7, the length of a period T21 and a period T22 may be changed (T21≥T22).

The period T21 (time T2 to time T10) needs to be determined in consideration of the time period for increasing the voltage of the transmission-type target 24. On the other hand, the time T3 when application of the voltage to the transmission-type target 24 ends may be set earlier, because emission of electrons from the electron source 21 ended at the time T11. Therefore, the period T22 (from the time T11 to the time T3) may be shorter than the period T21 (from the time T2 to the time T10). When such a configuration is adopted, generation of an unnecessary X-ray can be suppressed, and the time period during which a voltage is applied to the transmission-type target 24 can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An X-ray radiography apparatus, comprising:

an X-ray generator which generates an X-ray, an X-ray detector which detects an X-ray from said X-ray generator that has been transmitted through a subject, a controller which controls said X-ray generator and said X-ray detector, wherein said X-ray generator has an X-ray tube comprising an electron source configured to emit electrons in response to application of a voltage, a transmission-type target configured to generate the X-ray due to collision of electrons emitted from said electron source, and a shield member disposed between said electron source and said transmission-type target, said shield member having an opening through which electrons emitted from said electron source pass, said shield member being configured to block an X-ray that scatters toward said electron source, and said controller, when generating the X-ray, starts application of a voltage between said transmission-type target and said electron source, and causes emission of electrons from said electron source after passage of a predetermined period from the start of voltage application until the voltage between said transmission-type target and said electron source reaches a predetermined voltage, and when stopping generation of the X-ray, stops application of the voltage between said transmission-type target and said electron source after stopping the emission of electrons from said electron source.

2. The X-ray radiography apparatus according to claim 1, further comprising a display unit which displays a radiographic image of the subject that has been captured by said X-ray detector.

3. The X-ray radiography apparatus according to claim 1, wherein a time period from stopping emission of electrons from said electron source until stopping application of the voltage between said transmission-type target and said electron source is shorter than a time period from said transmission-type target reaching the predetermined voltage until emission of electrons from said electron source begins.

4. The X-ray radiography apparatus according to claim 1, wherein said X-ray tube further comprises a lens electrode disposed between said electron source and said shield member, and a voltage source applying to said lens electrode a first voltage that is less than the voltage applied to said electron source, said controller, when generating the X-ray, after starting application of a voltage between said transmission-type target and said electron source, switches the voltage applied to said lens electrode from the first voltage to a second voltage that is higher than the voltage applied to said electron source, and causes emission of electrons from said electron source after passage of said predetermined period from the start of voltage application between said transmission-type target and said electron source, and said controller, when stopping generation of the X-ray, stops the emission of electrons from said electron source, and stops application of the voltage between said transmission-type target and said electron source after switching the voltage applied to said lens electrode from the second voltage to the first voltage.

5. The X-ray radiography apparatus according to claim 1, wherein said X-ray tube further comprises a lens electrode disposed between said electron source and said shield member, and a voltage source applying to said lens electrode a first voltage that is less than the voltage applied to said electron source, said controller, when generating the X-ray, starts application of a voltage between said transmission-type target and said electron source after switching the voltage applied to said lens electrode from the first voltage to a second voltage that is higher than the voltage applied to said electron source, and said controller, when stopping generation of the X-ray, switches the voltage applied to said lens electrode from the second voltage to the first voltage after stopping application of the voltage between said transmission-type target and said electron source.

6. The X-ray radiography apparatus according to claim 1, wherein said controller stores information relating to the predetermined period.

7. An X-ray generating apparatus, comprising:

an X-ray tube configured to generate an X-ray; and a controller configured to control driving of said X-ray tube, the X-ray tube comprising:

an electron source configured to emit electrons in response to application of a voltage, a transmission-type target configured to generate the X-ray due to collision of electrons emitted from said electron source, and a shield member disposed between said electron source and said transmission-type target, said shield member having an opening through which electrons emitted from said electron source pass, said shield member being configured to block an X-ray that scatters toward said electron source, and said controller being configured to, when generating the X-ray, start application of a voltage between said transmission-type target and said electron source, and cause emission of electrons from said electron source after passage of a predetermined period from the start of voltage application until the voltage between said transmission-type target and said electron source reaches a predetermined voltage, and when stopping generation of the X-ray, stop application of the voltage between said transmission-type target and said electron source after stopping the emission of electrons from said electron source.

* * * * *